US007845120B2

(12) United States Patent
Thome et al.

(10) Patent No.: US 7,845,120 B2
(45) Date of Patent: Dec. 7, 2010

(54) DEVICE FOR FIXING A SOUND-PROOFING PANEL ON A WALL

(75) Inventors: Jean-Philippe Thome, Conflans Sainte Honorine (FR); Guy-Eric Holtzapffel, Senlis (FR)

(73) Assignee: Technofirst, Aubagne (FR)

( * ) Notice: Subject to any disclaimer, the term of this patent is extended or adjusted under 35 U.S.C. 154(b) by 505 days.

(21) Appl. No.: 10/544,726

(22) PCT Filed: Feb. 21, 2003

(86) PCT No.: PCT/FR03/00581

§ 371 (c)(1),
(2), (4) Date: Mar. 6, 2006

(87) PCT Pub. No.: WO03/071043

PCT Pub. Date: Aug. 28, 2003

(65) Prior Publication Data

US 2006/0179762 A1 Aug. 17, 2006

(30) Foreign Application Priority Data

Feb. 22, 2002 (FR) ..... 02/02309

(51) Int. Cl.
*E04B 1/82* (2006.01)

(52) U.S. Cl. ..... 52/144; 52/385; 52/464; 52/774; 52/775

(58) Field of Classification Search ..... 52/144, 52/145, 385, 464, 466, 467, 468, 506.05, 52/506.06, 506.07, 506.08, 512, 764, 772, 52/774, 775

See application file for complete search history.

(56) References Cited

U.S. PATENT DOCUMENTS

| | | | | |
|---|---|---|---|---|
| 3,225,502 | A * | 12/1965 | Hallauer | 52/461 |
| 3,340,663 | A * | 9/1967 | Collard | 52/775 |
| 3,889,435 | A * | 6/1975 | Ollinger | 52/506.07 |
| 4,015,388 | A * | 4/1977 | Hemminger | 52/395 |
| 5,444,945 | A * | 8/1995 | Goodwin | 52/65 |
| 5,560,155 | A * | 10/1996 | Back | 52/90.1 |
| 5,727,356 | A * | 3/1998 | Ensinger et al. | 52/717.02 |
| 6,141,923 | A * | 11/2000 | Habicht et al. | 52/235 |
| 6,205,732 | B1 * | 3/2001 | Rebman | 52/506.07 |
| 6,499,262 | B1 * | 12/2002 | Pinchot et al. | 52/273 |
| 6,640,507 | B1 * | 11/2003 | Leconte | 52/145 |
| 7,165,367 | B2 * | 1/2007 | Habicht | 52/407.1 |
| 2003/0019184 | A1 * | 1/2003 | Habicht | 52/730.6 |

FOREIGN PATENT DOCUMENTS

| | | |
|---|---|---|
| DE | 298 09 317 U1 | 9/1998 |
| EP | 0 000 118 A | 1/1979 |
| EP | 2 798 945 | 3/2001 |
| GB | 630311 | 10/1949 |

* cited by examiner

*Primary Examiner*—Richard E Chilcot, Jr.
*Assistant Examiner*—Branon C Painter
(74) *Attorney, Agent, or Firm*—Oliff & Berridge, PLC

(57) ABSTRACT

The present invention relates to a device for attaching at least one acoustic panel (1) to a wall (P) characterized by having first attaching means (10) associated with wall (P) and second attaching means (20) associated with said acoustic panel(s) (1), said first (10) and second (20) attaching means being connected to each other by elastic connecting means (30). By adjusting the elasticity of the connecting means, the frequency of each acoustic panel can be individually tuned to treat the various sound frequency ranges. In addition, the device according to the invention enables the acoustic panels to be disconnected from the wall on which they are mounted, thus increasing the insulation of the room.

15 Claims, 2 Drawing Sheets f
P
20
40
41
41
50
60
2
1
3
20
30
10

DEVICE FOR FIXING A SOUND-PROOFING PANEL ON A WALL

The present invention relates to a device for attaching an acoustic panel to a wall, as well as an acoustic treatment method using such a device.

Certain spaces such as public or private movie theaters or recording studios, rooms, meeting rooms, etc. require thorough acoustic treatment over the entire frequency range (low, medium, and high) to enable transmitted sounds to be properly restored.

This acoustic treatment is generally done by treating walls (wall partitions, ceilings, etc.) using in particular panels that enable the medium and high frequencies to be controlled.

These acoustic panels can for example be made of acoustic resonators in the case of medium frequencies or reversible absorbing or reflecting panels in the case of high frequencies.

However, under certain conditions, the appearance of low frequencies greatly interferes with sound quality.

This phenomenon is most pronounced in small rooms where low-frequency control by mechanical resonance with rigid panels does not lead to predictable, reproducible results.

Moreover, tuning a standard panel to the desired frequency takes intricate and time-consuming adjustment.

U.S. Pat. No. 2,798,945 teaches a device for attaching acoustic panels to the structure of a building comprising a pair of lower and upper profiles designed to be rigidly attached to the building frame to hold the acoustic panel in place.

However, this type of attachment device does not allow the acoustic panel to be completely disconnected from the supporting wall, thus damaging the sound quality of the space delimited by said walls since a certain frequency range, particularly low frequencies, cannot be effectively controlled by this type of device.

In this context, the present invention remedies the drawbacks of the prior art by proposing an acoustic panel attachment device that treats the entire sound frequency range to confer an optimal sound quality on a space depending on the intrinsic characteristics of said space.

For this purpose, according to the invention, the device for attaching at least one acoustic panel to a wall is characterized by having first attaching means associated with the wall, second attaching means associated with said acoustic panel(s), with said first and second attaching means being connected to each other by elastic connecting means.

Advantageously, the elasticity of the connecting means is adjustable, as said connecting means can, more specifically, be elastically deformable.

According to one advantageous embodiment, the elastic connecting means comprise profiles made of elastomeric thermoplastic polymers, or metal elements with elastic properties.

Preferably, the first and second attaching means are removably associated with the elastic connecting means.

According to a first embodiment, the first and second attaching means comprise profiles made essentially in a U-shape whose concavities face each other, the legs of the U being connected together by elastic connecting means.

According to a second embodiment, in order to receive two contiguous acoustic panels, the profile of the first means is shaped essentially in double juxtaposed U's, the second means having two essentially U-shaped profiles each facing one of the U's of the profile of the first means, the U legs of the first means being connected to the U legs of the second means facing them by elastic connecting means.

Advantageously, the device according to the invention has a center mast shaped so as to be insertable between the two juxtaposed U's of the first attaching means, said mast including stopping means to prevent the acoustic panels associated with the second attaching means from tilting.

According to a particular embodiment, the device has locking means able to cooperate with the center mast, said locking means being essentially T-shaped so that they can be inserted into a corresponding shape in the center mast.

Advantageously, the acoustic panel or panels are associated removably with the second attaching means, for example by gluing or by a double-faced adhesive.

The invention also relates to a method for acoustic treatment of a space defined by walls, characterized in that acoustic panels are used to cover all or part of the walls, said acoustic panels being associated with said walls by means of attachment devices according to the invention.

Advantageously, the acoustic panels are reversible, each face providing different treatment of the received sound, for example with one face absorbing sound while the other face reflects sound.

The present invention will be better understood from the description hereinbelow that relates to an illustrative and by no means limiting exemplary embodiment, with reference to the attached drawings wherein.

In the entire following description, the attachment device according to the invention is applied to one or more standard acoustic panels 1, of any known type.

Figure 1:
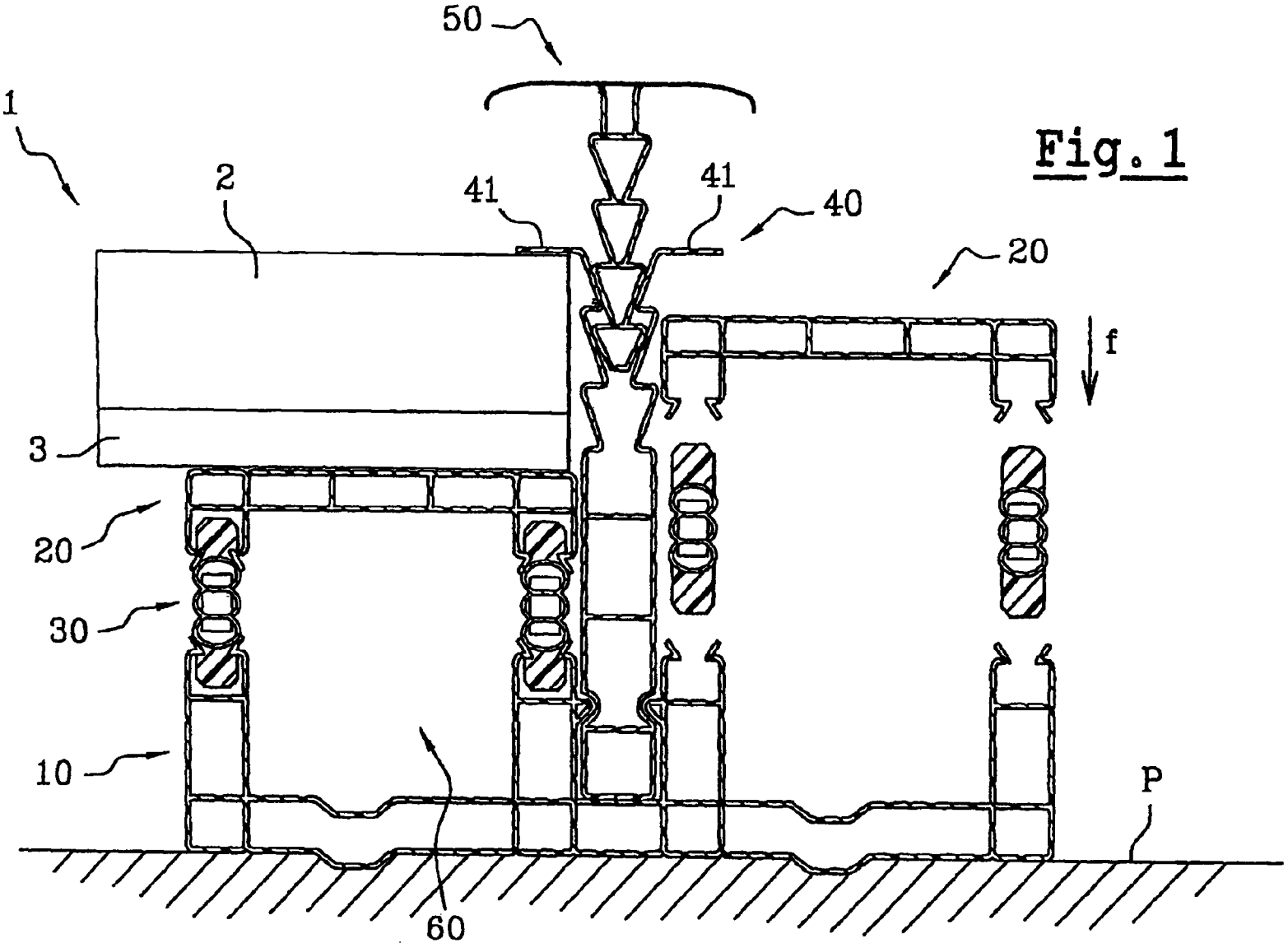
FIG. 1 is a schematic cross-sectional view of one embodiment of the present invention.

For example, said acoustic panels 1 can be reversible panels for absorbing or reflecting sounds, such as those shown in FIG. 1.

For this purpose, the acoustic panels 1 are, in known fashion, composed of a first slab 2 of compressed mineral wool such as glass wool, associated with a second slab 3 of plaster.

Said acoustic panel 1 absorbs sound when mineral wool slab 2 is disposed at the outside of the attachment device, or reflects sound when the plaster slab 3 faces outward. Also, acoustic panels 1 can be covered with a film of black fiberglass.

FIG. 1 is a schematic representation in cross section of one embodiment of the attachment device according to the invention.

In the embodiment shown in FIG. 1, the attachment device holds two acoustic panels in position side by side, only one of them being shown in FIG. 1.

The attachment device according to the invention has first attaching means 10 designed to be associated with supporting wall P which the acoustic panels 1 will abut, as well as second attaching means 20 designed to be associated with an acoustic panel 1.

The first and second attaching means (10, 20) are associated together by connecting means 30, which are elastically deformable.

The first and second attaching means (10, 20) are removably connected to the elastic connecting means 30 so that they can easily engage or disengage each other, as shown by arrow f.

The acoustic panel 1 is associated with second attaching means 20 by any known means such as gluing, attaching by double-faced adhesive, etc.

According to the particular embodiment illustrated in FIG. 1, and to prevent the acoustic panels 1 from tilting, the attachment device according to the invention has a center mast 40 equipped with stopping means designed to hold acoustic panels 1.

Said center mast 40 is removably associated with first attaching means 10 so that stopping means prevent acoustic panels 1 from tilting but without compressing them so as to leave them enough freedom to vibrate freely.

Center mast 40 is also able to cooperate with locking means 50 which are essentially T-shaped so that they can be inserted into a matching shape in center mast 40.

Locking means 50 can for example hold in position a lining fabric that covers the acoustic panels 1 that are held in place by the attachment device.

Figure 2:
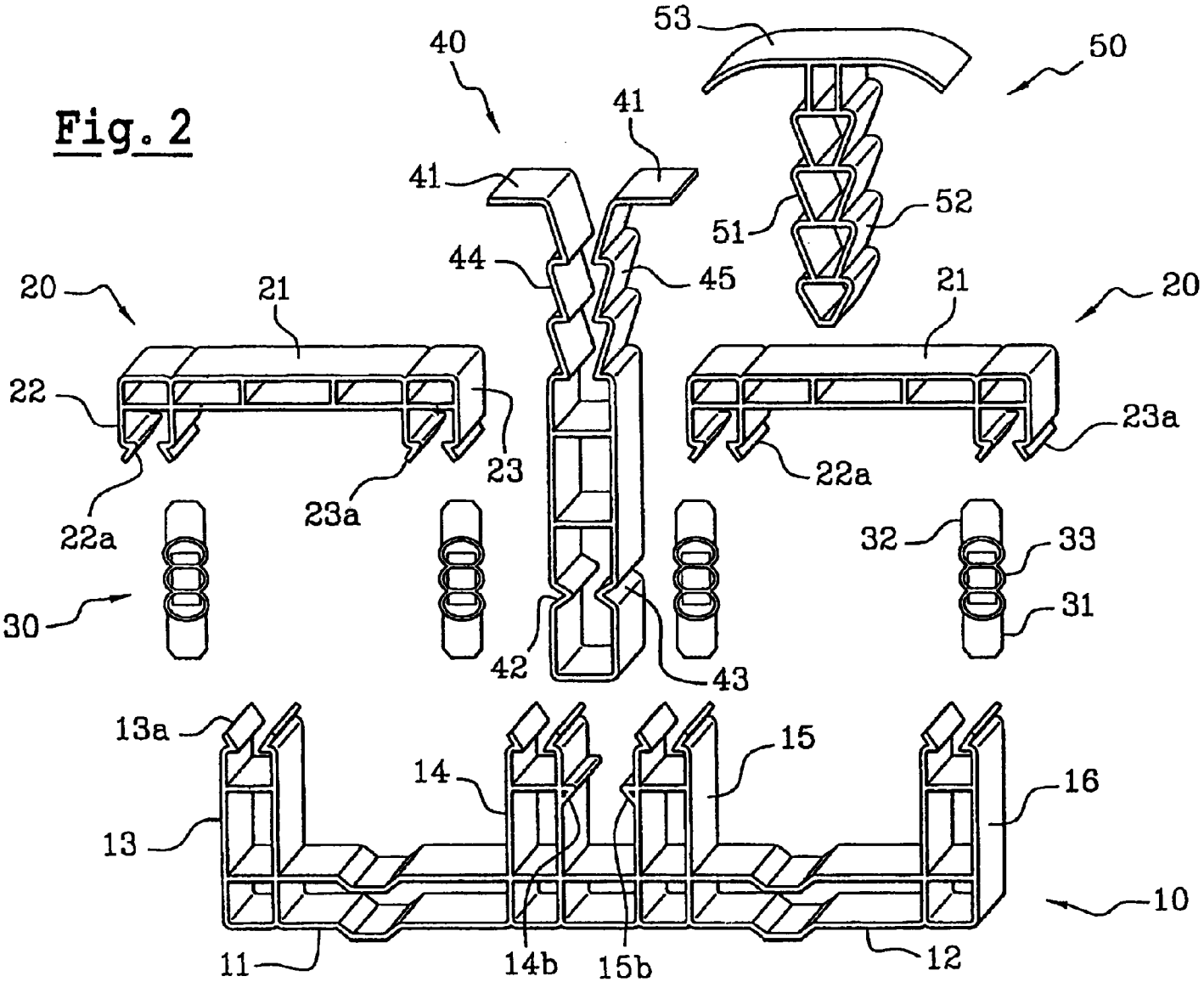
FIG. 2 is an exploded perspective view of the attachment device in FIG. 1.

With reference to FIG. 2, the various means employed in the device according to the invention will now be described in detail, the acoustic panels not being shown for reasons of clarity.

FIG. 2 is an exploded perspective view of the various elements of which the attachment device shown in FIG. 1 is composed.

In this particular embodiment, the first attaching means 10 are made of a profile made essentially of two juxtaposed U's, the webs 11 and 12 of each U being designed to be associated with the supporting wall P (not shown) by any known attaching means.

The free end of each leg (13, 14, 15, 18) of the U's has holding means referenced (13*a*, 14*a*, 15*a*, 16*a*) respectively.

Said holding means 13*a* to 16*a* are essentially dovetail-shaped so that they can cooperate with the matching shapes of the elastic connecting means 30.

The inside faces of inside legs (14, 15) of each U have projecting locking means (14*b*, 15*b*) shaped to cooperate with matching shapes in center mast 40 inserted between inside legs 14 and 15 of the U's of first attaching means 10.

The second attaching means 20 are also substantially U-shaped with the concavities facing the concavities of the U's of first attaching means 10.

The second attaching means 20 are thus made of a pair of U-shaped profiles whose webs 21 face the webs (11, 12) of the first attaching means 10 once the various elements are assembled.

The legs 22 and 23 of each U of the second attaching means are relatively short, and their respective free ends are provided with holding means (22*a*, 23*a*) identical to the holding means (13*a* to 16*a*) of the ends of the legs (13 to 16) of the U's of first attaching means 10.

The space between legs 22 and 23 of each U of the second attaching means 20 is identical to that between the legs (13, 14) and (15, 16) of the first attaching means 10 so that the various legs of the various U's are disposed to face each other, respectively, when they are connected by elastic connecting means 30.

For this purpose, the elastic connecting means have a plurality of elastically deformable elements that provide the link between the legs of the U's of the first attaching means 10 and the corresponding legs of the U's of the second attaching means 20.

Each elastically deformable element has two lugs (31, 32) connected to each other by an elastic zone 33.

Each of lugs (31, 32) is shaped to cooperate with the holding means (13*a* to 16*a*) and (22*a* to 25*a*) disposed at the free ends of each of the legs of the U's of the first and second attaching means (10, 20).

Said free ends of each of the U-legs have some elasticity so that the lugs (31, 32) of the holding means can be inserted and withdrawn without affecting the physical intactness of the U-shaped profiles.

The elastic zone 33 connecting lugs (31, 32) is made of an elastically deformable material such as an elastomeric thermoplastic.

Thus, according to one particular embodiment, each element of which elastic connecting means 30 are composed can be comprised of an elastic profile made by extruding a suitable polymer.

According to another embodiment, the elastic connecting means 30 can be made of metal elements having elastic characteristics such as metal profiles, springs, etc.

As stated above, the center mast 40 is made so that it cooperates with the inside faces of lower legs (14, 15) of the U's of which the first attaching means 10 are comprised.

For this purpose, the center mast 40 has a first substantially long and slender part with a quadrangular cross section, the two opposite faces whereof have notches (42, 43) that can cooperate with the projecting parts (14*b*, 15*b*) respectively of the inside faces of inside legs (14, 15) of the U's of the first attaching means 10.

The elasticity of the inside legs (14, 15) allows the center mast 40 to be removably inserted as well as held in position.

Also, center mast 40 has a second part composed of two walls (44, 45) that begin at one end of the long and slender part of central mast 40 (the end opposite that associated with first attaching means 10) and gradually flare out.

The walls (44, 45) of center mast 40 have a notched surface and end in two tabs 41 that are substantially perpendicular to the general lengthwise axis of the center mast 40, said tabs 41 forming stopping means designed to hold the acoustic panels when the latter are connected to second attaching means 20.

In order to keep in position the decorative fabric with which the acoustic panels will be covered once they are in place, the device according to the invention also provides locking means 50 with an essentially T-shape that cooperate with the center mast 40.

For this purpose, the vertical bar of the T-shaped locking profile is composed of two walls (51, 52) each of which has a notched outer surface able to cooperate with the notches in walls (44, 45) respectively of the center mast 40.

The relative elasticity of the walls (44, 45) of the center mast 40 enables the locking means 50 to be inserted or withdrawn at any time, said means also having a cross-element 53 designed to facilitate gripping.

Thus, the device according to the invention easily enables a plurality of acoustic panels to be attached to a wall or ceiling, etc. by disposing the first attaching means 10 on said wall and associating the second attaching means 20 to the peripheries of acoustic panels 1.

The first attaching means 10 can thus be made in a simple U-shape when they are attached to the edge of a wall, or juxtaposed in a double U when two contiguous acoustic panels are to be attached, for example in the middle of a wall.

The attachment device according to the invention thus allows a standard acoustic panel 1 to be tuned to any frequency by varying the elasticity of the connecting means 30.

The elastic link between the first and second attaching means 10 and 20 is modified by adjusting the number of deformable elements as well as their lengths or their intrinsic characteristics.

This adaptation of the elastic link enables the oscillation frequency of the acoustic panels 1, which act as a rigid, oscillating mass, to be varied.

Thus, the low frequencies are absorbed by a mass-spring system where the mass is comprised of acoustic panels 1 designed to handle the medium and high frequencies.

By means of the attachment device, the acoustic panels 1 are totally disconnected from the wall with which they are associated, and by adjustment of the elasticity of the connecting means, each acoustic panel 1 can be tuned to a different resonance frequency.

The device according to the invention thus provides a disconnecting effect both from the inside of the space toward the outside and from the outside to the inside.

Moreover, when the attaching means (10, 20) are connected together by means of the elastic connecting means 30, they delimit a pipe 60 for routing the power or control cables, or a ventilation duct.

Finally, installation of the attachment device according to the invention provides an air gap between wall P and acoustic panels 1, with a thickness equal to that of the attachment device, said air gap increasing the sound insulation of the space enclosed by walls P, particularly with respect to the surrounding rooms.

The invention claimed is:

1. Device for attaching at least one acoustic panel to a wall, comprising:

a first attaching device associated with the wall;

a second attaching device associated with the acoustic panel; and an elastic connecting device, the elastic connecting device comprising a unitary one piece structure that includes two pluggable lugs connected to each other by an elastic zone disposed between the two pluggable lugs, elasticity of the elastic connecting device being adjustable in response to a specified acoustic frequency, wherein one of the two pluggable lugs is plugged into the first attaching device and the other of the two pluggable lugs is plugged into the second attaching device, the first and second attaching devices comprising profiles, wherein in order to receive two contiguous acoustic panels, the profile of the first attaching device has substantially a shape of two juxtaposed U's, and the second attaching device comprises two substantially U-shaped profiles each facing one of the two juxtaposed U's of the profile of the first attaching device, legs of the juxtaposed U's of the first attaching device being connected to legs of the U's of the second attaching device facing them by the elastic connecting device.

2. Device according to claim 1, wherein the elastic zone of the elastic connecting device comprises an elastically deformable material.

3. Device according to claim 2, wherein the elastic zone of the elastic connecting device comprises an elastomeric thermoplastic polymer.

4. Device according to claim 1, wherein the first and second attaching devices are removably associated with the elastic connecting device.

5. Device according to claim 1, wherein the profiles have a substantially U shape with concavities facing each other, legs of the U's being connected together by the elastic connecting device.

6. Device according to claim 1, further comprising a center mast shaped so as to be inserted between the two juxtaposed U's of the first attaching device, the mast having a stopping device that inhibits tilting of the acoustic panel associated with the second attaching device.

7. Device according to claim 6, further comprising a locking device that cooperates with the center mast.

8. Device according to claim 7, wherein the locking device has a substantially T-shape configured to engage a corresponding shape of the center mast.

9. Device according to claim 1, wherein the acoustic panel is associated removably with the second attaching device.

10. Device according to claim 9, wherein the acoustic panel is associated with the second attaching device by gluing or by a double-faced adhesive.

11. Device according to claim 1, wherein the elastic connecting device comprises a metal material with elastic properties.

12. Device according to claim 1, wherein the first attaching device and the second attaching device are spaced from each other in a direction perpendicular to the plane of the wall.

13. Method of acoustic treatment of a space defined by walls comprising: providing an attachment device comprising: a first attaching device associated with the wall;

a second attaching device associated with the acoustic panel; and an elastic connecting device, the elastic connecting device comprising a unitary one piece structure that includes two pluggable lugs connected to each other by an elastic zone disposed between the two pluggable lugs, elasticity of the elastic connecting device being adjustable in response to a specified acoustic frequency, wherein one of the two pluggable lugs is plugged into the first attaching device and the other of the two pluggable lugs is plugged into the second attaching device, the first and second attaching devices comprising profiles, wherein in order to receive two contiguous acoustic panels, the profile of the first attaching device has substantially a shape of two juxtaposed U's, and the second attaching device comprises two substantially U-shaped profiles each facing one of the two juxtaposed U's of the profile of the first attaching device, legs of the juxtaposed U's of the first attaching device being connected to legs of the U's of the second attaching device facing them by the elastic connecting device; and covering at least a part of a wall with an acoustic panel, the acoustic panel being associated with said wall by said attachment device.

14. Method according to claim 13, the acoustic panel is reversible, with each face providing a different treatment of the received sound.

15. Method according to claim 14, wherein one face provides absorption of the sound while the other face provides reflection of the sound.

* * * * *